US006536627B1

(12) United States Patent
Benoit-Gonin et al.

(10) Patent No.: US 6,536,627 B1
(45) Date of Patent: Mar. 25, 2003

(54) RECLOSABLE POURER SPOUT FOR A CONTAINER

(75) Inventors: Claude Benoit-Gonin, Odenas (FR); Andre Orsaud, Montmirey le Chateau (FR)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/890,911

(22) PCT Filed: Jan. 31, 2000

(86) PCT No.: PCT/GB00/00256

§ 371 (c)(1),
(2), (4) Date: Jan. 17, 2002

(87) PCT Pub. No.: WO00/47480

PCT Pub. Date: Aug. 17, 2000

(30) Foreign Application Priority Data

Feb. 8, 1999 (FR) ..... 99 01580

(51) Int. Cl.[7] ..... B65D 41/32; B65D 5/74

(52) U.S. Cl. ..... 222/83; 222/541.2; 222/541.7; 222/546; 222/556; 229/125.04; 229/125.08; 229/125.09; 229/125.14; 229/204; 220/267; 220/258.4

(58) Field of Search ..... 222/83, 541.2, 222/541.6, 541.7, 541.9, 556, 546; 229/125.04, 125.08, 125.09, 125.14, 204; 220/267, 258.4

(56) References Cited

U.S. PATENT DOCUMENTS 4,915,290 A * 4/1990 Robichaud et al. .... 229/125.14
4,934,590 A * 6/1990 Robichaud et al. .... 229/125.14
5,101,999 A * 4/1992 Robichaud et al. .... 229/125.14
5,947,316 A * 9/1999 Guillonnet ..... 229/204
6,041,968 A * 3/2000 Weiteder ..... 229/125.15
6,216,945 B1 * 4/2001 Gabrielli et al. ..... 229/125.08
6,244,503 B1 * 6/2001 Miller et al. ..... 229/125.04
6,257,449 B1 * 7/2001 Baerenwald ..... 229/204
6,354,467 B1 * 3/2002 Mabee ..... 222/556

FOREIGN PATENT DOCUMENTS

WO WO 92/18394 10/1992

* cited by examiner

*Primary Examiner*—Kenneth Bomberg
(74) *Attorney, Agent, or Firm*—Diller, Ramik & Wight

(57) ABSTRACT

A pourer spout for a composite package of the carton brick type, arranged to be located level with the opening zone of the latter. The pourer spout comprises a base (2) fixed onto the container around the opening zone, and an articulated cover (4), able to reclose the container after opening. A perforating piece (6) is mounted pivotally on the base (2), facing the opening zone, in order to be moved between an initial position in which it is situated entirely outside the container to a final position in which it is situated substantially inside the container. A striker (8) is mounted pivotally on the base (2) in order to push the perforating piece (6) towards the inside of the container while perforating the wall of the latter and to more or less take the initial position of the perforating piece (6), the striker (8) in this last position acting as pourer.

12 Claims, 2 Drawing Sheets

RECLOSABLE POURER SPOUT FOR A CONTAINER

BACKGROUND OF THE INVENTION

The present invention relates to a reclosable pourer spout for a container, such as a composite carton brick type package. Such packages are made from composite sheets comprising in particular a layer of board and a layer of aluminium.

The above-mentioned type of package is often used because it offers numerous advantages compared with bottles made of glass or synthetic material. In fact, these packages are often of parallelepiped shape, which allows optimum storage without loss of space. In addition, these packages allow a very good preservation of food products.

It is known to provide such a carton brick with an opening zone in which the aluminium foil is exposed. A device forming a pourer spout is then mounted level with this opening zone.

Document WO 92/18394 discloses a device allowing the opening and hermetic reclosure of a package of the carton brick type. This device comprises a base situated level with an opening zone of the package, the opening zone provided with predefined cuts for this purpose. A cover, articulated with respect to the base, co-operates with the latter in order to provide a seal when closed. In order to open the package, a puncturing device is provided, mounted pivotally on the base. After opening the cover, a user pushes one end of the puncturing device all the way inside the package so as to create an opening. Said puncturing device is provided, for example, with a point or with a spout.

On first opening of this package, the user presses on the puncturing device using a finger, in such a way that he opens the package by cutting the wall of the latter. Subsequent opening and closing of the package is simply achieved by opening and closing the cover, the puncturing device remaining inside the package. The drawback of such a device is that the user puts his finger into the product when he is exerting pressure on the puncturing device. This is not very hygienic. In addition, taking into account the resistance offered by the package during cutting, first opening of the package is sometimes rather sudden and is accompanied by liquid being projected outside the package.

The aim of the present invention is therefore to provide a reclosable pourer spout, which allows a first opening of a package of the carton brick type, allowing the container upon which it is mounted to be opened neatly without contact of the user's finger with the product.

For this purpose, the present invention provides a reclosable pourer spout for a container, such as a composite package of the carton brick type, mounted level with an opening zone of the latter, comprising a base fixed on the container around the opening zone, and an articulated cover able to reclose the container after opening.

According to the invention, this pourer spout additionally comprises:

- an annular perforating piece mounted pivotally on the base, facing the opening zone, and designed to move between an initial position in which it is entirely outside the container and a final position in which it is substantially inside the container, and
- a striker mounted pivotally on the base and designed to thrust the perforating piece towards the inside of the container, perforating the wall of the latter and more or less taking the initial position of the perforating piece, the striker in this latter position acting as pourer.

Therefore, the striker pushes the perforating piece towards the inside of the package and it is not necessary for the user to put a finger inside the container in order to open it.

This solution also has other advantages. In particular, it is possible to provide the striker with a device allowing ventilation of the container during pouring, which is not possible with the devices currently on the market. In addition, the opening made in the wall of the package remains completely clear because the striker holds the perforating piece inside the package at the end of its stroke.

In a preferred embodiment of the invention, the perforating piece comprises a ring provided with teeth facing the opening zone in the initial position and articulated on the base by means of a hinge. One can ensure that the perforating piece does not have a tooth close to the hinge. In this embodiment, the perforating piece is advantageously in the form of a chimney of variable height so as to promote a progressive perforation of the wall of the package when it is pushed by the striker.

The striker is preferably mounted articulated about two hinges situated on either side of the striker, more or less between the striker and the perforating piece in the initial position of the latter. This allows good guidance of the striker when it is pushing the perforating piece.

In order to ensure that the striker does not return to its starting position due to elastic effect, snap-fitting means are advantageously provided in order to hold it in its final position when it has pushed the perforating piece.

In order to facilitate the setting in motion of the striker, a gripping tab is provided on the striker.

The pourer spout according to the invention can be made tamper-proof by providing at least one small tamper-proof bridge between the striker and the base in the initial position of the striker.

For better pouring and in order to avoid making the liquid flow along an outer wall of the package, the striker, when this has taken the place of the perforating piece, advantageously projects in part outside the base. It is then sufficient to provide a recess in the cover in order to allow reclosure without being impeded by the striker.

The invention will be better understood by means of the following description, with reference to the attached schematic drawings representing a non-limiting example of a preferred embodiment of the invention.

DESCRIPTION OF THE PREFERRED EMBODIMENTS

Figure 1:
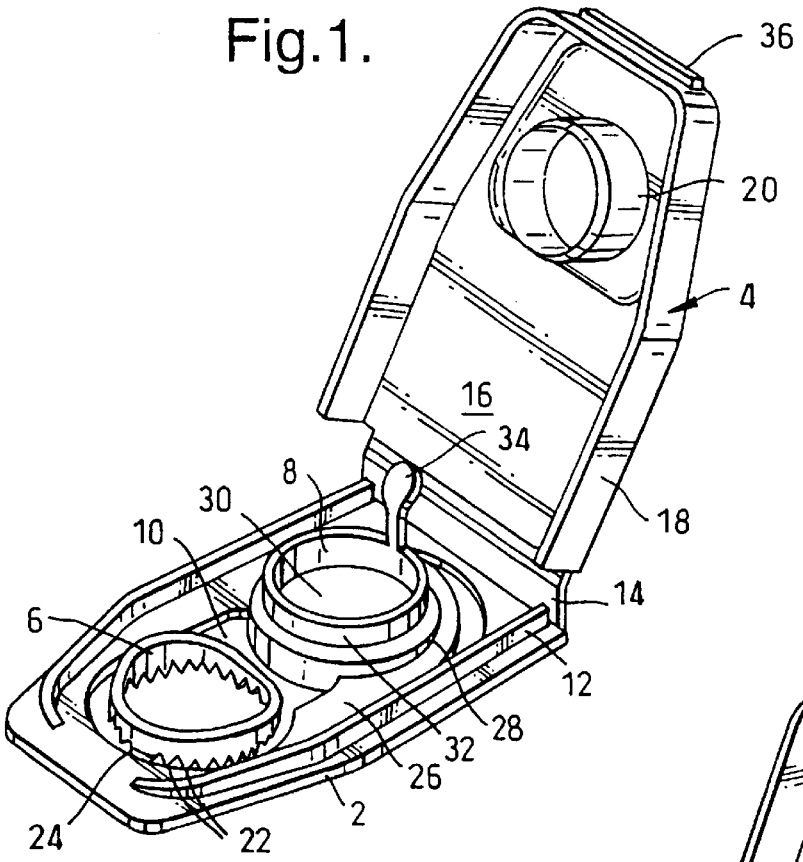
FIG. 1 is a perspective view of the device according to the invention before opening.

The device represented in the drawings is designed to be fixed, for example by gluing, on to the upper face of a package of parallelepiped shape, generally called a carton brick. Such packages comprise two rectangular sheets of composite material, comprising in particular one layer of board and one layer of aluminium, welded together and folded so as to form a parallelepiped. This type of package is well-known and is commonly used in the packaging of food products, in particular beverages.

FIG. 1 shows a pourer spout comprising a base 2, a cover 4, and a perforating piece 6 and a striker 8, both mounted on the base 2. The whole of this assembly is made of synthetic material, such as polypropylene for example, and is produced for example by injection moulding. One can produce this pourer spout in a single moulding operation, the cover being open flat in the moulding position.

The base 2 is designed to be applied against a wall of a package of the carton brick type. It is of more or less elongated, rectangular shape and inside has a recess 10 in which the perforating piece 6 and the striker 8 are located. The recess 10 is designed to be located facing an opening zone (not represented) in the package. If the package is made of board/aluminium composite material, the opening zone will, for example, be devoid of the layer of board, in order to facilitate the opening of the package.

The base 2 is fixed, for example by gluing, on to the package around the opening zone. As can be seen in the drawings, the base 2 comprises a flange 12 designed to co-operate with the cover 4 in order to hold the latter in the closed position.

Figure 2:
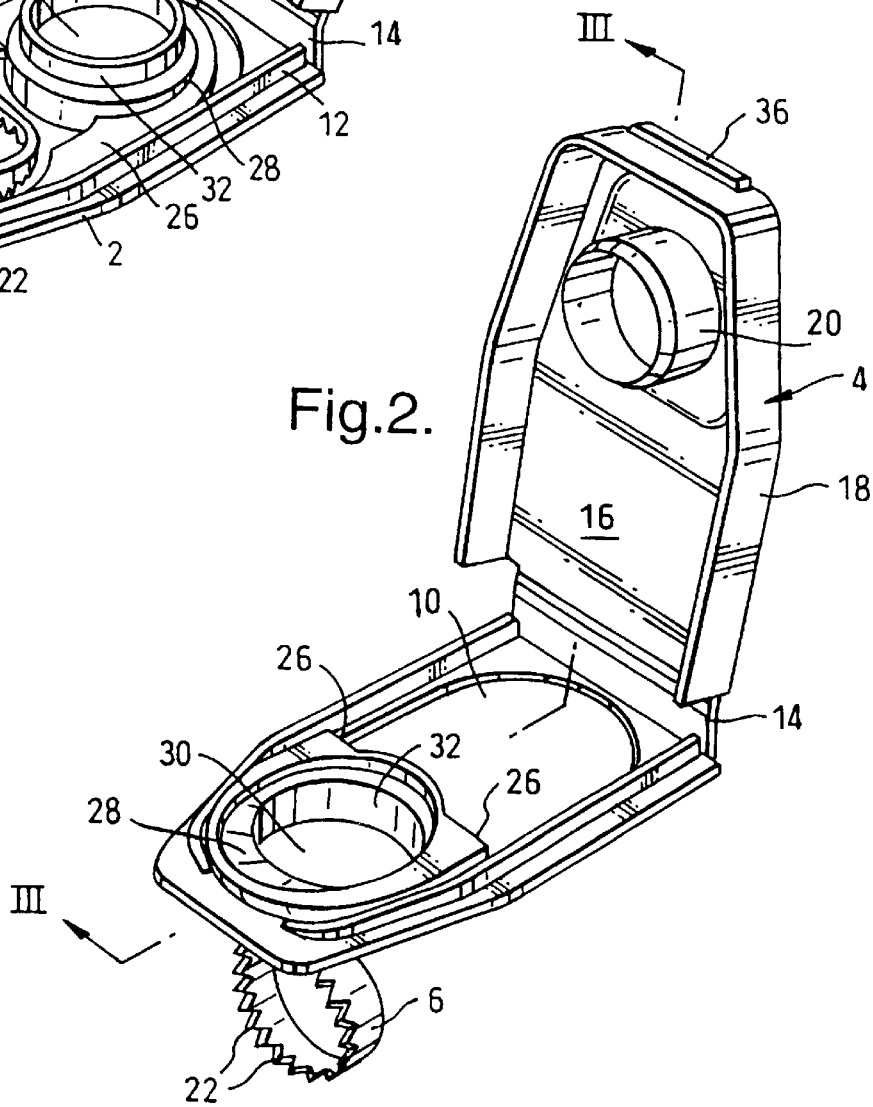
FIG. 2 is a view corresponding to that of FIG. 1 after opening.
Figure 3:
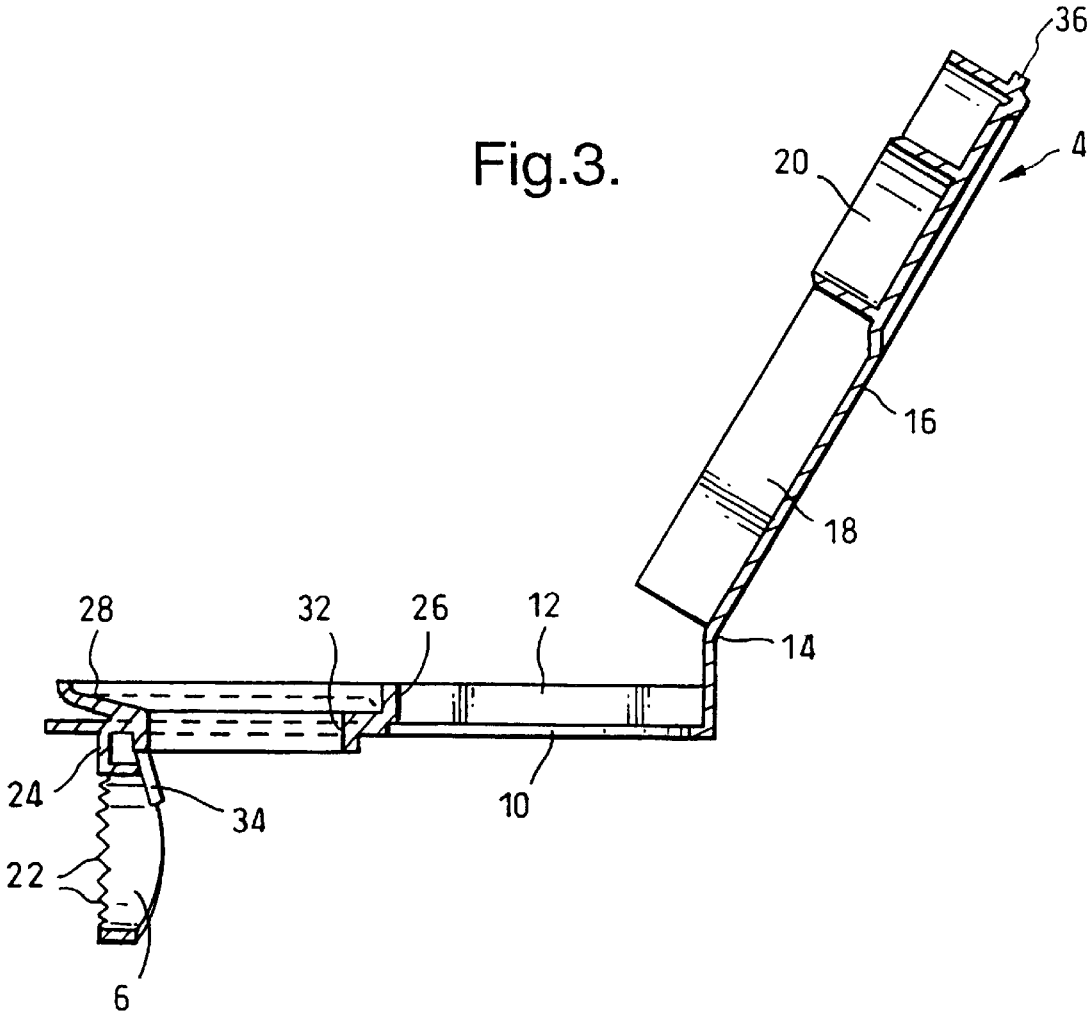
FIG. 3 is a cut-away view along the line III—III of FIG. 2.

On a short side of the base 2, there is a hinge 14 allowing the articulation of the cover 4. The latter more or less takes on the outer shape of the base 2. It has a more or less flat bottom 16 as well as a flange 18 oriented towards the base 2 and designed to co-operate with the flange 12 on base in order to close the pourer spout according to the invention. A chimney 20 projects from the bottom of the cover 16 in order to complete the closure of the device according to the invention. This chimney 20 is designed to co-operate with the striker when the latter is in the position represented in FIGS. 2 and 3.

The perforating piece 6 is of more or less cylindrical shape. As shown best in FIG. 3, the height of this piece is variable. When the base 2 is fixed onto a package, and before opening of the latter, the perforating piece extends more or less at right angles to the wall of the package which it is facing. The edge of the perforating piece facing the package is provided with pointed teeth 22 so as to be able to perforate the layer of aluminium.

The perforating piece 6 is situated in the recess 10, before opening of the package, on the side opposite the hinge 14. A tab 24 forming a hinge, joins the perforating piece 6 to the base 2. The striker 8 makes it possible to move the perforating piece from its outer position, before opening, to its inner position, after opening. Before opening it is situated between the hinge 14 and the perforating piece 6, in the recess 10 of the base 2. It is articulated on the base 2 by means of two hinges 26 situated on either side of the recess 10, on the long sides of the latter, at equal distance from the hinge 14. This striker can then pivot in order to take the place of the perforating piece 6 in the recess 10.

The striker 8 comprises a flange 28 forming a pourer spout. Before opening, in the moulding position, this flange is more or less in the plane of the recess 10. It is attached to the base 2 by the hinges 26. A neck 32 extends from the periphery of the opening 30 towards the outside of the package, when the device according to the invention is in the position represented in FIG. 1, before first opening of the package. A gripping tab 34 is provided on the neck 32, to facilitate the gripping of the striker 8.

The working of the device described above is as follows. At the end of moulding, the device is more or less in the position represented in FIG. 1, the cover 4 being more or less parallel to the base 2 and to the side of the latter. The perforating piece 6 and the neck of the striker 8 extend more or less parallel in a direction perpendicular to the plane of the base 2 and the recess 10. The base 2 is then fixed, for example by gluing, onto a wall of a package (not represented). This package preferably has an opening zone at the place where the device according to the invention is located. The cover 4 is then closed in order to prevent dirt from getting to the level of the striker 8 designed to serve subsequently as a pourer spout.

In order to open the package, the cover 4 is opened. A small bar 4, opposite the hinge 14, can be provided in order to facilitate the gripping of the cover. Once the cover is open, a user disengages the perforating piece and the striker 8. The latter is then pivoted about 180° to take the place of the perforating piece 6. The gripping tab 34 facilitates this manoeuvre. In order to achieve tamperproofness, small frangible bridges may be provided to join the base 2 to the flange 28 of the striker 8. So, if a user finds that the bridges (not represented) are broken, he might well suspect that the pourer spout has been used previously. During the pivoting of the striker, the neck 32 of the latter meets the perforating piece 6. The neck 32 rests on the perforating piece 6 on the side opposite the tab 24. The teeth 22 then cut the aluminium layer of the package. As the pivoting of the striker 8 progresses, the perforating piece 6 folds away inside the package. The perforating piece 6 pivots about 90° in total. The variable height of the perforating piece 6 makes it possible to have a progressive entry into the package. At the start, when the teeth 22 attack the layer of aluminium, the stroke of perforating piece 6 is weak and the force exerted by this piece 6 on the aluminium layer is increased. Once the cutting of the layer of aluminium is well under way, the force required for cutting is less important and a more rapid stroke of the perforating piece 6 is then promoted. At the end of the stroke of the striker 8, and therefore also of the perforating piece 6, the striker snap-fits on to the base 2. This can be achieved, for example, by providing a boss on the outer face of the neck 22, which then co-operates with the edge of the recess 10.

The liquid in the package can then be poured out. It passes through the opening 30 of the striker 8. In order to reclose the package, it is sufficient to lower the cover 4 on to the base 2. The chimney 20 is then arranged in such a way that it tightly closes the opening 30 and the neck 32.

In its open position, the striker 8 holds the perforating piece 6 inside the package. The latter then does not disturb the flow of the liquid out of the package. Moreover, the device according to the invention allows a flow reducer to be placed in the opening 30. Numerous devices can be placed in this opening, allowing the flow of liquid to be regulated and promoting a regular discharge of the latter outwards. Thus, a good ventilation of the package is ensured.

In order to promote better pouring, it is possible to arrange for the flange 28 of the striker 8 to project beyond the base 2 in the open position. It is then sufficient to provide a notch in the cover 4 in order to allow the closure of the cover after opening of the package. This is important when one wants to guarantee that the liquid is not going to flow over the outer wall of the package when a user is pouring.

As emerges from the above description, it is not necessary to put a finger inside the package in order to achieve the opening of the same. Moreover, thanks to the progressive opening action, there are no splashes.

Finally, the use of this pourer spout is simple and ergonomic. There is no risk of any part of this device injuring a finger of the user carrying out the opening of the package.

As is obvious, the invention is not limited to the embodiment described above by way of a non-limiting example; on the contrary, it embraces all the variants within the framework of the claims below.

Therefore, for example, the numerous teeth of the perforating piece may be replaced by one or two knives. One can likewise arrange to only have teeth on one part of the periphery of the perforating piece, The perforating piece is described as a piece having a variable height. One would not be straying from the framework of the invention if the height of this piece was constant. One can imagine that the neck of the striker is itself of variable height. This embodiment is then equivalent. One can also have a chimney and a neck of constant height. This shape is not optimal but likewise allows the device according to the invention to work well.

The position and number of hinges is given as a rough guide. Other positions, both for the cover and for the striker and the perforating piece, are possible. Likewise, the more or less rectangular shape of the device can be modified.

The presence of snap-fitting means, the gripping tab, small tamperproof bridges, a chimney level with the cover, etc. is, of course, optional.

Although a preferred embodiment of the invention has been specifically illustrated and described herein, it is to be understood that minor variations may be made in the apparatus without departing from the spirit and scope of the invention, as defined the appended claims.

What is claimed is:

1. A reclosable pourer spout for a container comprising a base (2) adapted to be fixed around an opening zone of a container and an articulated cover (4) adapted to close a container before first opening, an annular perforating piece (6) mounted pivotally on the base (2) for facing a container opening zone and being movable between an initial position in which the annular perforating piece (6) is entirely outside a container and a final position in which the annular perforating piece (6) is substantially inside a container, and a striker (8) mounted pivotally on the base (2) for thrusting the perforating piece (6) towards an inside of a container and perforating a wall of a container and taking the initial position of the perforating piece (6), and the so positioned striker (8) serving as pourer.

2. The pourer spout as defined in claim 1 wherein the perforating piece (6) and the striker (8) are mounted directly on the base (2) and are so mounted separately of the cover (4).

3. The pourer spout as defined in claim 1 wherein the perforating piece and the striker are arranged to pivot about different axes.

4. The pourer spout as defined in claim 1 wherein the perforating piece (6) is a ring provided with teeth (22) facing, in the initial position, the opening zone of the container and articulated on the base (2) by means of a hinge (24).

5. The pourer spout as defined in claim 4 wherein the perforating piece (6) does not have a tooth close to the hinge (24).

6. The pourer spout as defined in claim 1 wherein the perforating piece (6) is in the form of a chimney of variable height so as to promote a progressive perforation of the wall of the package when it is pushed by the striker (8).

7. The pourer spout as defined in claim 1 wherein the striker (8) is mounted articulated about two hinges (26) situated on either side of the striker (8), between the striker (8) and the perforating piece (6) in the initial position of the latter.

8. The pourer spout as defined in claim 1 wherein snap-fitting means are provided in order to hold the striker (8) in position when it has pushed the perforating piece.

9. The pourer spout as defined in claim 1 wherein a gripping tab (34) is provided on the striker (8).

10. The pourer spout as defined in claim 1 wherein at least one small tamperproof bridge is provided between the striker (8) and the base (2) in the initial position of the striker.

11. The pourer spout as defined in claim 1 wherein the cover (4) has a sealing chimney (20) designed to co-operate with the striker (8) when the latter has taken the place of the perforating piece (6) so as to close off the pourer formed by the striker.

12. The pourer spout as defined in claim 1 wherein the striker (8), when it has taken the place of the perforating piece (6), projects partly outside the base (2).

* * * * *